US006510293B1

(12) United States Patent
Nozawa

(10) Patent No.: US 6,510,293 B1
(45) Date of Patent: Jan. 21, 2003

(54) IMAGE FORMING APPARATUS HAVING TONER DENSITY DETECTION AND IMAGE DENSITY CONTROL METHOD THEREFORE

(75) Inventor: Taizo Nozawa, Kanagawa-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/658,446

(22) Filed: Sep. 8, 2000

(30) Foreign Application Priority Data

Sep. 22, 1999 (JP) ..... 11-269267

(51) Int. Cl.[7] ..... G03G 15/00
(52) U.S. Cl. ..... 399/43; 399/49
(58) Field of Search ..... 399/43, 46, 49; 358/300, 400

(56) References Cited

U.S. PATENT DOCUMENTS 5,315,352 A * 5/1994 Nakahe et al. ..... 399/49
6,029,021 A * 2/2000 Nishimura et al. ..... 399/49

FOREIGN PATENT DOCUMENTS

JP 64-5291 1/1989

* cited by examiner

*Primary Examiner*—Joan Pendegrass
(74) *Attorney, Agent, or Firm*—Foley & Lardner

(57) ABSTRACT

The image density control method in the image forming apparatus including the charging unit for charging the photoconductor, the exposure unit for exposing the photoconductor and forming an electrostatic latent image, and the developing unit for visualizing the electrostatic latent image with toner comprises a step of forming a predetermined reference image by the developing unit, a step of detecting the toner density of the reference image, a step of setting a target density value or the reference image formed on the photoconductor according to the number of images to be formed, and a step of controlling so as to change at least one of the charging potential to be given to the photoconductor from the charging unit, the exposure amount at the time of exposure from the exposure unit to the photoconductor, and the development bias voltage given to the developing unit on the basis of the comparison result of the value detected at the detection step with the target density value set at the setting step.

14 Claims, 5 Drawing Sheets

| NUMBER OF COPIES | TARGET VALUE |
|---|---|
| 0～100, 000 | 830 |
| 100, 0000～200, 000 | 785 |
| 200, 000MORE | 740 |

| | ADVANTAGES | DISADVANTAGES |
|---|---|---|
| TWO-POINT CONTROLLER | THE FIXING PROPERTY OF PRINTER GAMMA IS HIGH | EXPENSIVE<br>THE CONVERGENCE TIME IS LONG |
| ONE-POINT CONTROLLER | INEXPENSIVE<br>THE CONVERGENCE TIME IS SHORT | THE FIXING PROPERTY OF PRINTER GAMMA IS LOWER THAN THAT OF THE TWO-POINT CONTROLLER |

IMAGE FORMING APPARATUS HAVING TONER DENSITY DETECTION AND IMAGE DENSITY CONTROL METHOD THEREFORE

BACKGROUND OF THE INVENTION

1. Field of the Invention

The present invention relates to an image forming apparatus and an image density control method for controlling the image density at fixed density over a long period of time.

2. Description of the Related Art

In the recent electrophotography field, the movement of realization of high image quality is remarkable regardless of a printer, digital copying machine, analog copying machine, color copying machine, and monochromatic copying machine.

Among them, realization of high image quality of a full-color digital printer and copying machine and a monochromatic digital printer and copying machine is a key point of product development.

Image forming can be broadly divided into two parts such as image forming by an image forming unit side image (hereinafter called printer gamma) and image forming by the image processing art.

Important matters for realizing high image quality are improvement of stability regarding the image forming unit side and how to find image processing parameters according to various documents regarding the image process.

When the image forming capacity on the image forming unit side is unstable even if image processing parameters are satisfactory, images obtained finally are varied widely and high image quality cannot be obtained.

Therefore, to make an image forming unit image, that is, the printer gamma stable, an image quality maintenance device may be incorporated.

The image quality maintenance device is almost incorporated in full color copying machines and full color printers and used in a part of monochromatic copying machines and monochromatic printers whenever necessary.

The image quality maintenance device is referred to as a device for maintaining a fixed printer gamma within the range from initial (movement start) to life (end of forming of a fixed number of images) or even if the environmental conditions such as temperature and humidity are changed.

In principle, a toner adhesion amount reading sensor is used and toner is adhered onto a photosensitive drum so as to form a patch image in a case (for example, during warming up) other than the actual image forming (copying or printing) operation. The sensor reads the toner adhesion amount for forming the patch image on the drum and controls so as to obtain a target toner adhesion amount. Or, the patch image on the drum is transferred onto a transfer belt and the sensor reads the toner adhesion amount on the transfer belt and controls so as to obtain a target toner adhesion amount.

In order to obtain the target toner adhesion amount, as disclosed in Japanese Patent Publication 64-5291, at least one of the peak value of the development bias AC voltage, frequency, and waveform center value is changed. In order to obtain the target toner adhesion amount, the process conditions such as the charged voltage, development speed, laser (exposure) conditions, and transfer conditions are generally controlled.

The image quality maintenance device is broadly divided into two parts such as a one-point controller and a two-point controller. They are shown in FIG. 4. The one-point controller is a controller for controlling only by one half tone point and the two-point controller is a controller for controlling by two points of a low-density part and a high-density part.

The advantages and disadvantages of the image quality maintenance devices of one-point control and two-point control are shown in FIG. 7.

As to the fixing property of the printer gamma, that is, whether the printer gamma is fixed as a result of matching, needless to say, the two-point control for matching at two locations is advantageous. The one-point controller matches at one half tone point, so that the fixing property in the neighborhood of the half tone is realized, though the matching may be shifted at the low-density part or high-density part. For example, as shown in FIG. 8, compared with the printer gamma at initial time and the printer gamma at life time in the case of the one-point control, the printer gamma at life time at the low-density part is darker (the image density is higher) than the printer gamma at initial time.

When the printer gamma is changed at life time like this, in a case of a copying machine, a dark image like insufficient exposure is formed and a problem arises that the toner consumption is increased. In a case of a printer, characters may be made thick.

At the half tone part, they coincide with each other because it is an image quality maintenance matching point. At the high-density part, in this case, there is little change observed between the initial time and the life time.

As mentioned above, that the printer gamma shape (characteristic) at initial time does not coincide with that at life time is caused by deterioration of the photosensitive drum, differences in the laser conditions between the initial time and the life time deterioration of the developer, and others.

The difference in the gamma shape between the initial time and the life time is beyond comparison with the difference caused by the machine body difference (individual difference).

The example shown in FIG. 8 is an example indicating a gamma change that the low-density part at life time is darker than that at initial time. However, depending on the machine body use conditions represented by the characteristics of the photoconductor and developer and laser conditions, gamma changes different from those shown in FIG. 8 may be indicated.

As mentioned above, with respect to the gamma fixing property, the one-point control has a lower fixing property than that of the two-point control and a problem arises that a density difference is generated at life time.

However, the two-point controller requires a toner adhesion amount sensor for accurately reading the wide density range of low density and high density. As a result, it is expensive and a problem arises that the convergence time is prolonged. In the two-point control, since the convergence time is long, a considerable time may be required before starting printing or copying and the toner consumption may be increased, so that it is desirable to make the convergence time as shorter as possible.

As explained above, the one-point controller is outstanding in the price and convergence time, while the two-point controller is advantageous in the function for making the required printer gamma constant.

SUMMARY OF THE INVENTION

An object of the present invention is to provide an image forming apparatus and an image density control method which are improved in disadvantages of a one-point controller and can be applied to such an apparatus represented by a digital full-color copying machine that a gamma fixing property on a high level is required.

According to the present invention, an image forming apparatus is provided and the image forming apparatus comprises a charging means for charging a photoconductor, an exposure means for exposing the photoconductor and forming an electrostatic latent image on the photoconductor, a development means for visualizing the electrostatic latent image with toner which forms a predetermined reference image using the toner, a detection means for detecting the toner density of the reference image, a means for setting a target density value of the reference image formed on the photoconductor according to the number of images to be formed, and a control means for changing at least one of the charging potential to be given to the photoconductor from the charging means, the exposure amount at the time of exposure from the exposure means to the photoconductor, and the development bias voltage given to the development means on the basis of the comparison result of the value detected by the detection means with the set target density value.

Furthermore, according to the present invention, an image density control method in an image forming apparatus including a charging means for charging a photoconductor, an exposure means for exposing the photoconductor and forming an electrostatic latent image, and a development means for visualizing the electrostatic latent image with toner is provided and the image density control method comprises a step of forming a reference image by the development means, a step of detecting the toner density of the reference image, a step of setting a target density value of the reference image formed on the photoconductor according to the number of images to be formed, and a step of controlling so as to change at least one of the charging potential to be given to the photoconductor from the charging means, the exposure amount at the time of exposure from the exposure means to the photoconductor, and the development bias voltage given to the development means on the basis of the comparison result of the value detected at the detection step with the target density value set at the setting step.

DETAILED DESCRIPTION OF THE PREFERRED EMBODIMENTS

The image forming apparatus of the present invention will be explained hereunder with reference to the accompanying drawings.

Figure 1:
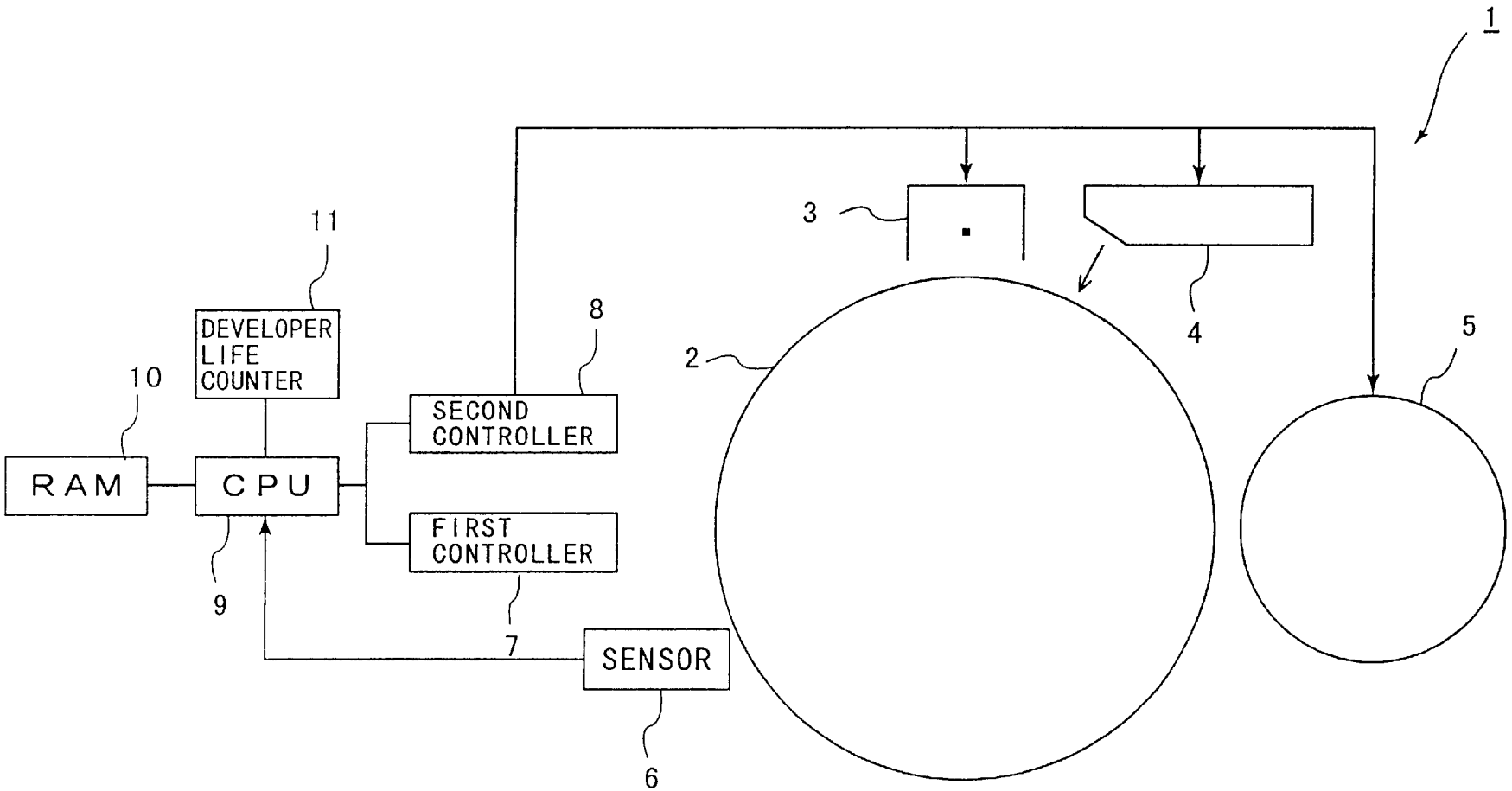
FIG. 1 is a schematic view showing an image forming apparatus of the present invention including an image quality maintenance device.

As shown in FIG. 1, an image forming apparatus 1 is composed of a photoconductor 2, a charging unit 3, an exposure unit 4, a developing unit 5, and a sensor 6.

Furthermore, the sensor 6 is connected to a CPU 9. To the CPU 9, a first controller 7, a second controller 8, a RAM 10, and a developer life counter 11 are connected respectively.

The photoconductor 2 is provided with a photosensitive thin layer which is an optical semiconductor on the outer surface and has a cylindrical shape. The charging unit 3 charges the surface of the photoconductor 2 at a predetermined potential. The exposure unit 4 exposes a document image on the charged photoconductor 2 and forms an electrostatic latent image. The developing unit 5 feeds toner to the electrostatic latent image formed on the photoconductor 2 by the exposure unit 4 and visualizes it. The sensor 6 detects the toner amount (image density) constituting the patch image as a predetermined test reference image formed on the photoconductor 2 by the developing unit 5.

Furthermore, the image forming apparatus has the first controller 7 for comparing the toner amount detected by the sensor 6 with the target value and identifying the corresponding control output and the second controller 8 for setting the charging output to be output by the charging unit 3 on the basis of the control output of the first controller 7, the development bias voltage to be fed to the developing unit 5, and the exposure output radiated from the exposure unit 4.

The sensor 6, the first controller 7, the second controller 8, the CPU 9, the RAM 10, and the developer life counter 11 constitute a one-point control image maintenance device. The first controller 7 controls the exposure pulse width for forming a target value, a patch image, and others.

Figure 2:
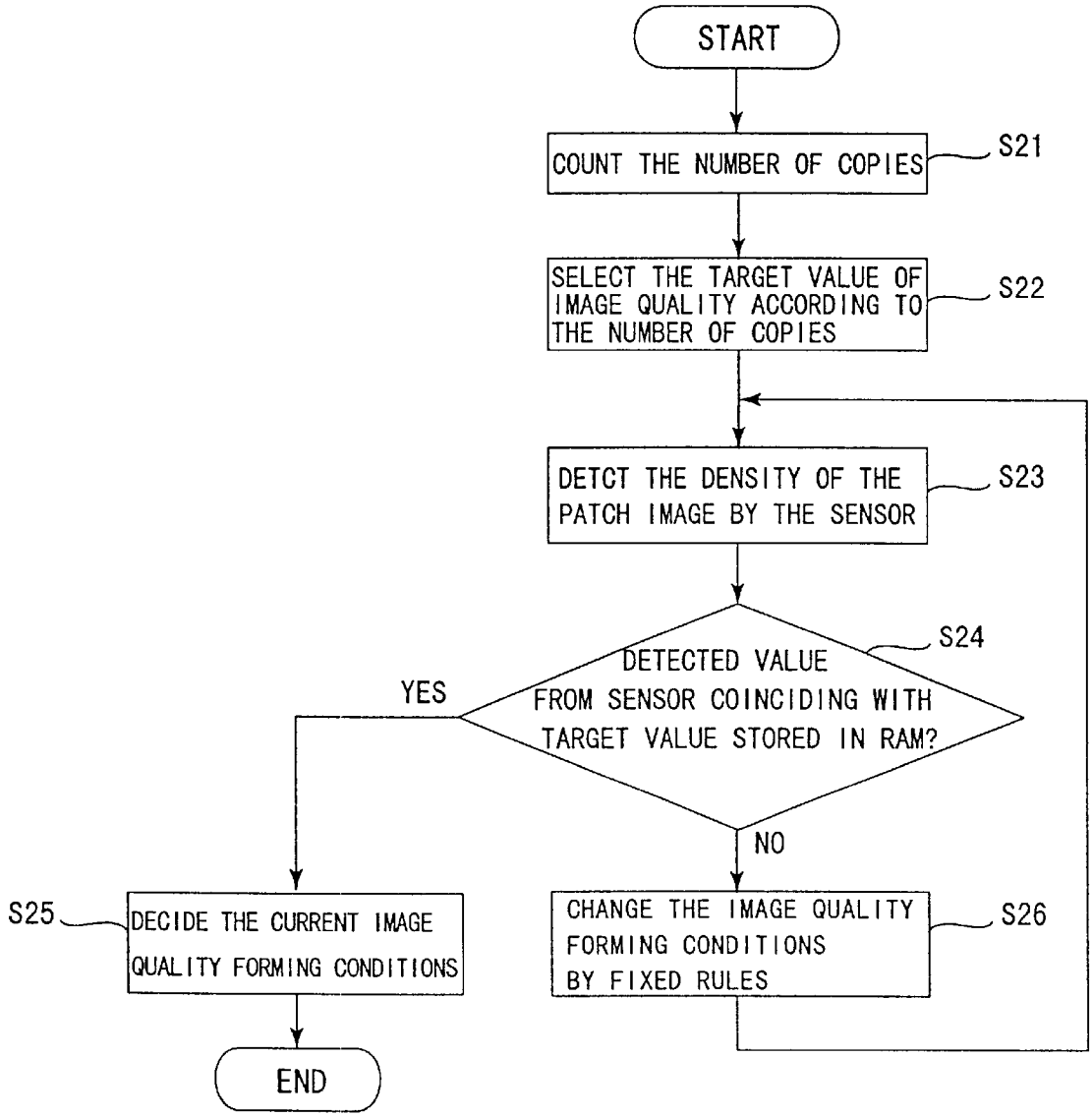
FIG. 2 is a flow chart for explaining the operation of the first embodiment of the present invention.

By referring to the flow chart shown in FIG. 2 and the table shown in FIG. 3, the operation of the image quality maintenance device of the present invention will be explained.

The developer life counter 11 counts the number of copies (Step S21). The CPU 9, as shown in FIG. 3, selects a target value of 830 for maintaining the image quality when the number of copies is within the range from 0 to 100,000 as a result of counting by the developer life counter 11, a target value of 785 when the number of copies is within the range from 100,000 to 200,000, and a target value of 740 when the number of copies is more than 200,000 (Step S22). The density of the patch image formed on the photoconductor 2 by the developing unit 5, that is, the toner amount is detected by the sensor 6 and the detected value is input to the CPU 9 (Step S23). The CPU 9 reads the target value corresponding to the number of copies counted by the developer life counter 11 and compares the target value with the detected value by the sensor 6 (Step S24).

As a result of the comparison at Step S24, when the target value matches with the detected value, the current image quality forming conditions are decided and the copying is continued.

As a result of the comparison at Step S24, when the target value does not match with the detected value, the image quality forming conditions are changed according to a fixed rule and the operation is returned to Step S23.

In the aforementioned embodiment, the target value is set according to the number of copies. However, there is no limit to it and the target value may be set according to the rotation drive distance of the photoconductor 2.

At initial time and life time, even if a patch image is formed in the same toner amount respectively, the output of the sensor is different between the initial time and the life time. Therefore, when the target value is always kept fixed, for example, even if a patch image is formed in a correct toner amount at life time, the sensor output is off the target value and incorrect image quality maintenance control is executed.

According to the present invention, such a problem can be eliminated and both at initial time and life time, appropriate image quality maintenance control can be executed.

Next, the second embodiment of the image quality maintenance device will be explained. The image quality maintenance device is referred to as a device for maintaining a fixed printer gamma within the range from initial (movement start) to life (end of forming of a fixed number of images) or even if the environmental conditions such as temperature and humidity are changed.

In a machine equivalent to TOSHIBA digital copying machine DP-6570, as a photoconductor, TOSHIBA photoconductor OD-6570 (OPC drum) is used and as a developer, TOSHIBA developer D-6570 (carrier with a particle diameter of 65 $\mu$m, durability of 400,000 copies) using a two-component developer and TOSHIBA toner T-6570 (a particle diameter of 9 $\mu$m) are used.

The number of life copies is 400,000 which is a compensation value of the machine body.

Figures 7, 8:
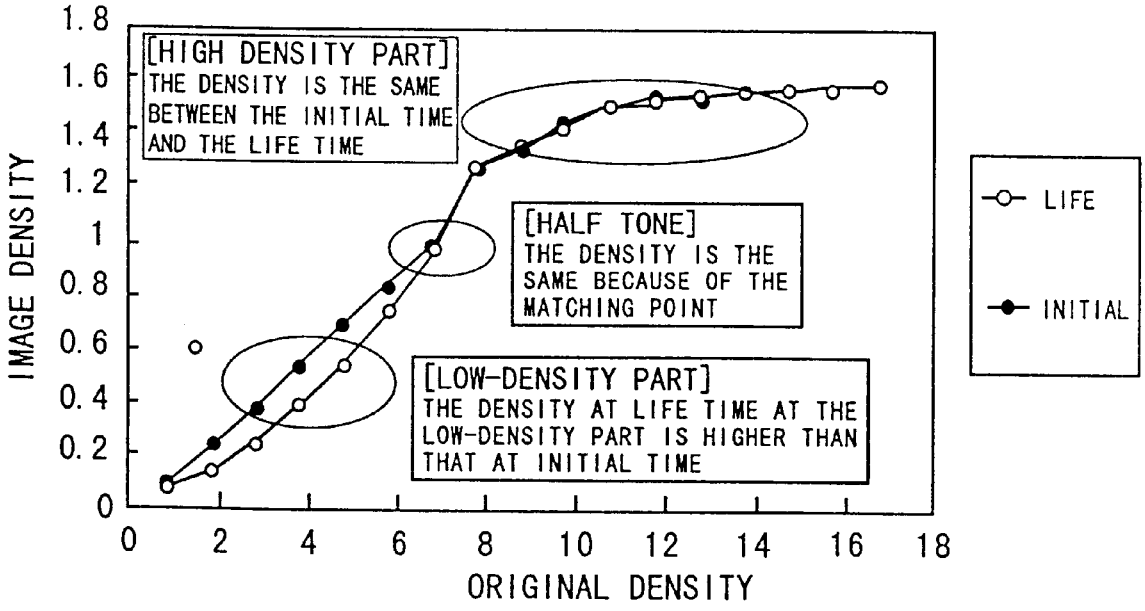
FIG. 7 is a table showing advantages and disadvantage of a known image quality maintenance device.
FIG. 8 is a graph showing a printer gamma of a known one-point control image quality maintenance device.

The faults caused by an inferior printer gamma fixing property, by referring to FIG. 8, are that the exposure becomes dark at life time and the toner consumption becomes worse.

Firstly, the matching process of the image quality maintenance device will be explained.

Generally, the image quality maintenance device has two conditions such as the target value about how to handle the gamma value to be matched, in this case, the half tone gamma value and the forming condition of a patch image to be read by the sensor.

Namely, so that a patch image is formed under a certain forming condition and it is read by the sensor and becomes a target value, it is repeated to change various conditions of the machine body such as the amount that the image forming unit of the image forming apparatus, that is, the photoconductor 2 shown in FIG. 1 is charged by the charging unit 3, the exposure amount when the charged photoconductor 2 is exposed by the exposure unit 4, and the magnitude of the development bias voltage applied to the developing unit 5. By this operation, the printer gamma is controlled fixed.

In the second embodiment, among the above conditions, control is added to the target value. Next, a method corresponding to the example that the image becomes dark at life time which is explained previously will be explained.

When the exposure at life time becomes dark as a faulty item, it is necessary to reduce the density at the low-density part of the printer gamma at life time and in order to improve the toner consumption, it is necessary to reduce the density at the high-density part at life time. Namely, it is necessary to reduce the gamma as a whole at life time.

To reduce the gamma as a whole is to make the target value smaller and in the second embodiment, the target value of image quality maintenance is controlled at life time.

With respect to the value to be controlled at life time, experimentally, the printer gamma is obtained using the target value as a parameter every 50,000 copies within the range from initial to 400,000 copies and the value is found from it. However, when the target value is reduced excessively, the gamma at the high-density part is reduced excessively and the image density becomes less than the lower limit (gamma meeting the density specification), so that in consideration of the balance with the image density, the life control value is decided. The results are shown in FIG. 4.

Figures 3, 4:
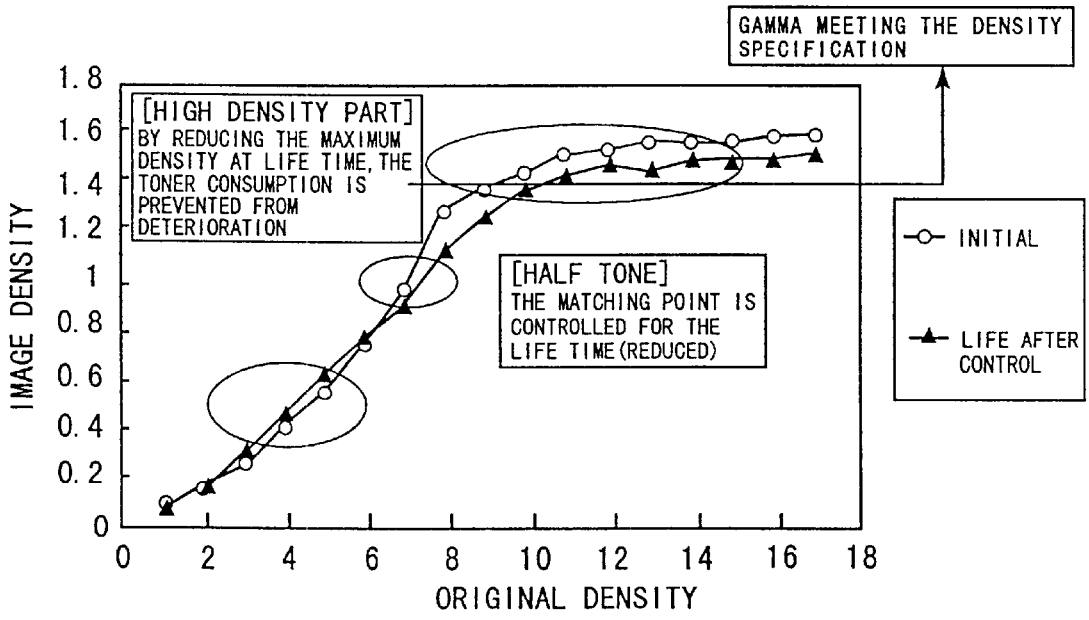
FIG. 3 is a table showing image quality maintenance target value data stored in a RAM.
FIG. 4 is a graph showing a printer gamma obtained by the second embodiment of the image quality maintenance device applied to the image forming apparatus shown in FIG. 1, FIG. 5 graph showing a printer gamma obtained by the third embodiment of the image quality maintenance device applied to the image forming apparatus shown in FIG. 1.

As shown in FIG. 4, the matching point is changed at initial time and life time and a gamma having a high fixing property is obtained after both the initial time and life time.

As shown in FIG. 4, at the low-density part, the gamma at initial time is almost equal to the gamma at life time and with respect to the high-density part where the exposure is higher (stronger), at life time, the image density is reduced within the range meeting the density specification and the toner consumption is suppressed. When the control value of the target value at life time is to be decided, care is taken to prevent the control value from reducing to the gamma meeting the density specification shown in FIG. 4 or less.

Advantages of the life control method for the target value like the second embodiment are that the control method is simple and the sensor for detecting the toner adhesion amount may be inexpensive because the sensor has only to read the half tone. A disadvantage is that since the method is easily affected by the background potential, as compared with the third embodiment which will be explained hereunder, the fixing property is inferior only slightly. The object of the present invention is to eliminate the two kinds of faults explained previously. However, as already described, the aforementioned faults are generated due to the test conditions (machine body and material) and any faults in other cases can be improved by the same algorithm.

Next, the third embodiment will be explained. The image forming apparatus and developer used for the experiment are the same as those shown in the second embodiment.

As explained previously, in the image quality maintenance device, as a gamma value matching method, there are a method for adding control to the target value and a method for adding control to the patch image forming conditions. Next, an example that control is added to the forming conditions of a patch image for which the toner adhesion amount is read by the sensor will be explained.

When the exposure becomes dark at life time as a faulty item, it is necessary to reduce the density at the low-density part of the printer gamma at life time and in order to improve the toner consumption, it is necessary to reduce the density at the high-density part. Namely, it is necessary to reduce the gamma as a whole at life time.

According to the third embodiment, the patch image forming condition is made stronger, that is, when a patch image is to be formed, it is changed to a condition of forming it slightly stronger. Namely, to form a slightly stronger patch image and make it match with the target value is equivalent to reduce the gamma as a whole at life time.

As mentioned above, the patch image forming condition for image quality maintenance is controlled for the life time.

With respect to the life control value, experimentally, the printer gamma is obtained using the patch image forming condition as a parameter every 50,000 copies within the range from initial to 400,000 copies and the value is found from it. However, when the patch image forming condition is strengthened excessively, the gamma at the high-density part is reduced excessively and the image density becomes less than the lower limit (gamma meeting the density specification), so that in consideration of the balance with the image density, the life control value is decided. The results are shown in FIG. 5.

Figure 5:
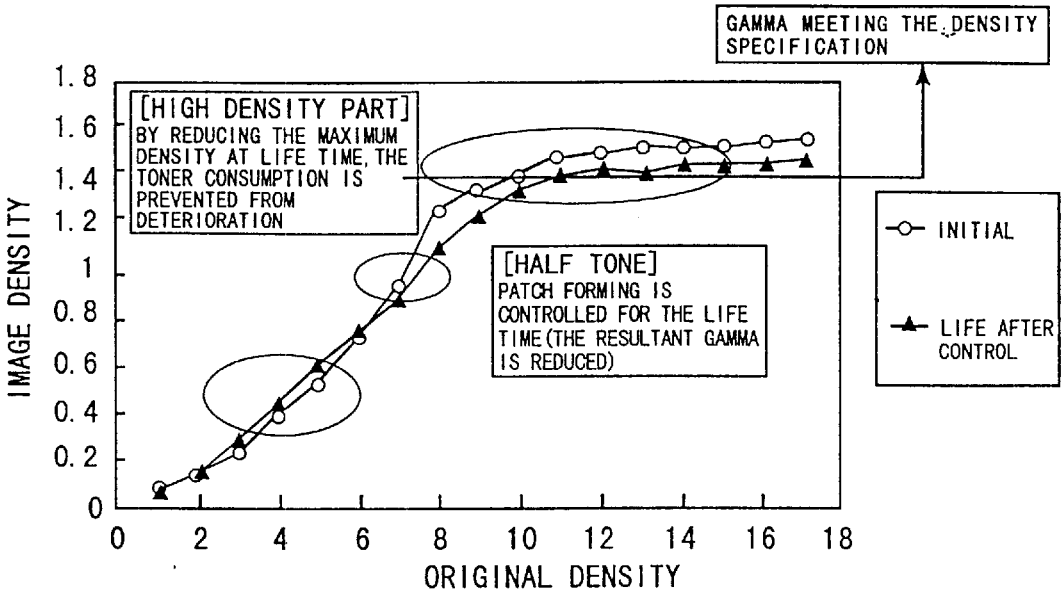
Figure 6:
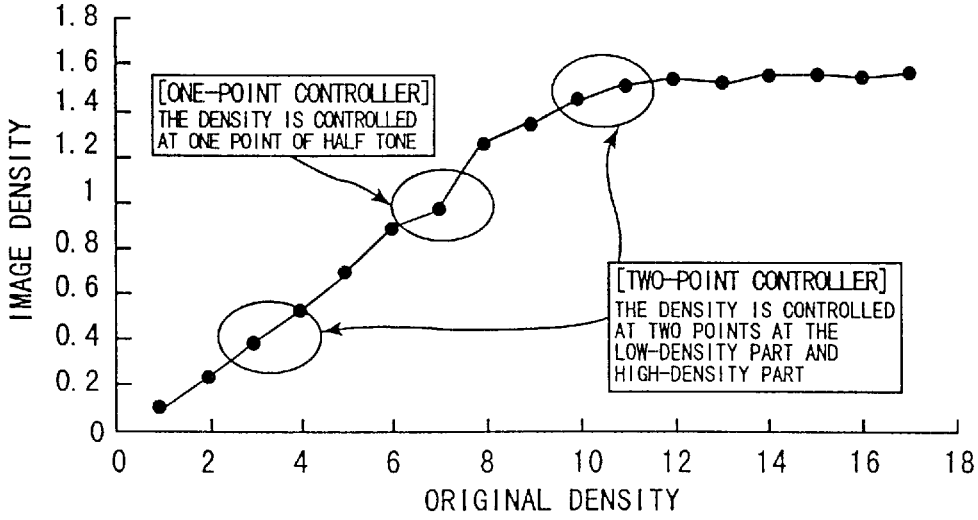
FIG. 6 is a graph showing a printer gamma of a known image quality maintenance device.

As mentioned above, the patch image forming condition, as shown in FIG. 5, is changed at initial time and life time and a gamma having a high fixing property is obtained after both the initial time and life time.

As shown in FIG. 5, at the low-density part, the gamma at initial time is almost equal to the gamma at life time. With respect to the high-density part where the exposure is higher (stronger), at life time, the image density is reduced within the range meeting the density specification and the toner consumption is suppressed. With respect to the high-density part, at life time, the image density is reduced within the range meeting the density specification and the toner consumption is suppressed.

When the patch image forming condition is to be decided, as shown in FIG. 5, care is required so as to prevent the control value from reducing to the gamma meeting the density specification or less at the high-density part.

As mentioned above, according to the third embodiment, the method for controlling the patch image forming condition for the life time is, after all, one-point control on the high density side compared with the conventional one-point control using the half tone for control.

As an advantage of the method, it may be cited that the fixing property is particularly stable because the method is not affected by the background potential. A disadvantage is that although the sensor is inexpensive compared with a sensor for detecting the toner adhesion amount for a two-point controller, it is more expensive than the sensor for a one-point controller used in the first embodiment explained previously in correspondence to the widened detection range. The object of the third embodiment is to eliminate the two kinds of faults explained previously. However, as already described, the aforementioned faults are generated due to the test conditions (machine body and material) and any faults in other cases can be improved by the same algorithm.

As mentioned above, the image forming apparatus of the present invention can eliminate faults such as changes in the exposure amount generated at life time by the one-point control in the image quality maintenance device and an increase in the toner consumption. Therefore, an inexpensive image quality maintenance device maintaining a high fixing property can be provided and an image forming apparatus that the image density is stable over a long period of time can be obtained.

What is claimed is:

1. An image forming apparatus comprising:

charging means for charging a photoconductor;

exposure means for exposing the photoconductor and forming an electrostatic latent image on the photoconductor;

development means for visualizing the electrostatic latent image with toner, which forms a predetermined reference image using the toner;

detection means for detecting a toner density value as a toner adhesion amount only at one point of a high-density part of the reference image;

means for setting a target density value of the reference image formed on the photoconductor according to the number of images to be formed; and control means for changing at least one of:

a charging potential to be given to the photoconductor from the charging means, an exposure amount at the time of exposure from the exposure means to the photoconductor, and a development bias voltage given to the development means, on the basis of a comparison result of the toner density value detected by the detection means with the set target density value.

2. An image forming apparatus according to claim 1, wherein the setting means, when the predetermined reference image is to be formed, changes the toner density value of the reference image in correspondence with a change with time of the photoconductor.

3. An image forming apparatus according to claim 1, wherein the setting means, when the reference image is to be formed, changes the toner density value of the reference image in correspondence with a change with time of the exposure means.

4. An image forming apparatus according to claim 1, wherein the setting means, when the reference image is to be formed, changes the toner density value of the reference image in correspondence with a change with time of a developer included in the development means.

5. An image forming apparatus according to claim 1, wherein the control means, in correspondence with a change in a printer gamma due to a change with time, changes at least one of the charging potential, the exposure amount, and the development bias voltage so that the toner density value of the reference image coincides with the target density value.

6. An image forming apparatus comprising:

charging means for charging a photoconductor;

exposure means for exposing the photoconductor and forming an electrostatic latent image on the photoconductor;

development means for visualizing the electrostatic latent image with toner, which forms a predetermined reference image using the toner;

detection means for detecting a toner density value as a toner adhesion amount only at one point of a high-density part of the reference image;

means for setting a target density value of the reference image formed on the photoconductor according to a change with time of at least one of the photoconductor, the exposure means, and a developer included in the development means; and control means for changing at least one of:

a charging potential to be given to the photoconductor from the charging means, an exposure amount at the time of exposure from the exposure means to the photoconductor, and a development bias voltage given to the development means, on the basis of a comparison result of the toner density value of the reference image changing according to a change with time which is detected by the detection means with the set target density value.

7. An image forming apparatus according to claim 6, wherein the control means changes the at least one of the charging potential, the exposure amount, and the development bias voltage so that the toner density value of the reference image coincides with the target density value, in correspondence with a change in a printer gamma due to a change with time.

8. An image density control method in an image forming apparatus including charging means for charging a photoconductor, exposure means for exposing the photoconductor and forming an electrostatic latent image, and development means for visualizing the electrostatic latent image with toner, comprising the steps of:

forming a predetermined reference image by the development means;

detecting a toner density value as a toner adhesion amount only at one point of a high-density part of the reference image;

setting a target density value of the reference image formed on the photoconductor according to the number of images to be formed; and controlling so as to change at least one of:

the charging potential to be given to the photoconductor from the charging means, the exposure amount at the time of exposure from the exposure means to the photoconductor, and the development bias voltage given to the development means, on the basis of a comparison result of the toner density value detected in the detection step with the target density value set in the setting step.

9. An image density control method according to claim 8, wherein the setting step, when the reference image is to be formed, changes the toner density value of the reference image in correspondence with a change with time of the photoconductor.

10. An image density control method according to claim 8, wherein the setting step, when the reference image is to be formed, changes the toner density value of the reference image in correspondence with a change with time of the exposure means.

11. An image density control method according to claim 8, wherein the setting step, when the reference image is to be formed, changes the toner density value of the reference image in correspondence with a change with time of a developer included in the development means.

12. An image density control method according to claim 8, wherein the control step, in correspondence with a change in a printer gamma due to a change with time, changes at least one of the charging potential, the exposure amount, and the development bias voltage so that the toner density value of the reference image coincides with the target density value.

13. An image density control method in an image forming apparatus including charging means for charging a photoconductor, exposure means for exposing the photoconductor and forming an electrostatic latent image, and development means for visualizing the electrostatic latent image with toner, comprising the steps of:

forming a predetermined reference image by the development means;

detecting a toner density value as a toner adhesion amount only at one point of a high-density part of the reference image;

setting a target density value of the reference image formed on the photoconductor according to a change with time of at least one of the photoconductor, the exposure means, and a developer included in the development means; and controlling so as to change at least one of:

charging potential to be given to the photoconductor from the charging means, an exposure amount at the time of exposure from the exposure means to the photoconductor, and a development bias voltage given to the development means, on the basis of a comparison result of the toner density value of the reference image changing according to a change with time which is detected by the detection means with the target density value set at the setting step.

14. An image density control method according to claim 13, wherein the control step, changes the at least one of the charging potential, the exposure amount, and the development bias voltage so that the toner density value of the reference image coincides with the target density value in correspondence with a change in a printer gamma due to a change with time.

* * * * *